US006379079B1

(12) United States Patent
Camomilla

(10) Patent No.: US 6,379,079 B1
(45) Date of Patent: Apr. 30, 2002

(54) ECOTECHNICAL COOPERATING SEPARATION LAYER FOR A PAVEMENT AND ITS MANUFACTURING PROCESS

(75) Inventor: Gabriele Camomilla, Rome (IT)

(73) Assignee: Autostrade Concessionie Costruzioni Autostrade S.p.A., Rome (IT)

( * ) Notice: Subject to any disclaimer, the term of this patent is extended or adjusted under 35 U.S.C. 154(b) by 0 days.

(21) Appl. No.: 09/647,998

(22) PCT Filed: Dec. 11, 1998

(86) PCT No.: PCT/IT98/00362

§ 371 Date: Oct. 10, 2000

§ 102(e) Date: Oct. 10, 2000

(87) PCT Pub. No.: WO99/53142

PCT Pub. Date: Oct. 21, 1999

(30) Foreign Application Priority Data

Apr. 10, 1998 (IT) ..... RM98A0230

(51) Int. Cl.[7] ..... E01C 3/06; E01C 3/00

(52) U.S. Cl. ..... 404/17; 404/27; 404/31; 404/82; 404/2

(58) Field of Search ..... 404/2, 17, 27, 404/28, 30, 31, 32, 82, 71; 405/50

(56) References Cited

U.S. PATENT DOCUMENTS

| | | | | | |
|---|---|---|---|---|---|
| 3,690,227 | A | | 9/1972 | Welty | |
| 3,870,422 | A | * | 3/1975 | Medico, Jr. | 404/17 |
| 4,319,854 | A | * | 3/1982 | Marzocchi | 404/28 |
| 4,396,312 | A | * | 8/1983 | Nilsson | 404/72 |
| 5,024,552 | A | * | 6/1991 | Baillemont et al. | 404/31 |
| 5,730,548 | A | | 3/1998 | Brero et al. | |
| 5,787,637 | A | * | 8/1998 | Keen | 47/25 |
| 5,863,147 | A | * | 1/1999 | Pressler | 404/17 |
| 5,906,454 | A | * | 5/1999 | Medico, Jr. et al. | 404/32 |
| 6,102,613 | A | * | 8/2000 | Medico, Jr. et al. | 404/17 |
| 6,146,051 | A | * | 11/2000 | Pratt | 404/2 |
| 6,206,607 | B1 | * | 3/2001 | Medico, Jr. et al. | 404/2 |

FOREIGN PATENT DOCUMENTS

| | | | | |
|---|---|---|---|---|
| DE | 296 21 187 | | 3/1997 | |
| DE | 19647361 | A1 * | 5/1998 | E02D/31/00 |
| DE | 19704165 | A1 * | 8/1998 | E02D/31/00 |
| DE | 19729230 | A1 * | 1/1999 | E02D/31/00 |
| GB | 2294077 | A * | 10/1995 | E01C/9/00 |
| WO | WO 89/09853 | | 10/1989 | |
| WO | WO 98/22669 | * | 5/1998 | E03F/1/00 |

* cited by examiner

*Primary Examiner*—Thomas B. Will
*Assistant Examiner*—Alexandra K Pechhold
(74) *Attorney, Agent, or Firm*—Young & Thompson

(57) ABSTRACT

Ecotechnical pavement comprising a draining and wearing course (1) and at least a second lower layer (2) of analogous structure. The particular granulometry of the layers (1, 2) and the choice of aggregates, insure both an optimum adherence and the absorption of medium and high acoustic frequencies produced by vehicle traffic. Between the two layers (1, 2) and the lower supporting layer (5) there is provided a "cooperating separation layer" (3) which transmits the forces produced by vehicle traffic to the supporting layer (5). The layer (3) acts as a Helmhotz resonator in order to absorb sound at low frequencies, besides allowing an easy transversal flow of rainwater, the passage of powder of heavy metals or the passage of other types of liquids; the latter, which may be dangerous or polluting, are collected in a lateral "reservoir pavement" (9). The separation layer prevents cracks due to fatigue from rising.

12 Claims, 8 Drawing Sheets

ECOTECHNICAL COOPERATING SEPARATION LAYER FOR A PAVEMENT AND ITS MANUFACTURING PROCESS

TECHNICAL FIELD

The present invention relates to a pavement (for roads), which is realized in such a way as to reduce the sound produced by vehicle traffic.

Moreover, the invention also relates to a pavement suited to collect solid or liquid pollutants which were accidentally poured thereon, so as to prevent their uncontrolled leakage in the surroundings.

These two features of the pavement, which are contained in the present invention, allow its classification in the range of so-called "ecotechnical" products, i.e.—in the present case—, with features reducing to a minimum the consequences for the environment due to the use of the road.

BACKGROUND ART

Pavements with drainage and sound absorption properties are already known in the art. A way to obtain these properties is to utilize a particular asphalt granulometry.

It has been observed that these type of pavements have high sound absorption coefficients in the high frequency range, exceeding 800–1000 Hz.

Other conventional means for sound reduction, such as acoustic barriers, vegetation and special casings for houses, have analogous sound absorption features.

However, vehicle traffic represents a source of sound which mostly contains medium-low frequencies. For this reason pavements having the feature to absorb this type of sound have also been developed, but the form of the cavities and the passage of sound waves and rain water is totally different from the present invention, and moreover, the way the pavement resists to fatigue loads due to road traffic also differs from the present invention.

DISCLOSURE OF INVENTION

An object of the present invention is to realize an ecotechnical (road) pavement and the related manufacturing process, wherein besides high frequency noise, also medium-low frequency noise is reduced.

Another object of the invention is to disconnect or separate the upper layers of the pavement from the lower ones, in such a way as to allow the high frequency sound to be absorbed by the upper layers, and the medium-low frequency sound to be absorbed through the effect produced by the separation layer acting like a Helmholtz resonator.

A further object of the present invention is to use the separation layer, besides for the absorption of medium-low frequency acoustic waves, also as an efficient Other conventional means for sound reduction, such as acoustic barriers, vegetation and special casings for houses, have analogous sound absorption features.

However, vehicle traffic represents a source of sound which mostly contains medium-low frequencies. For this reason pavements having the feature to absorb this type of sound have also been developed, but the form of the cavities and the passage of sound waves and rain water is totally different from the present invention, and moreover, the way the pavement resists to fatigue loads due to road traffic also differs from the present invention.

U.S. Pat. No. 3,690,227 discloses a frictional, in situ self-draining structure for roadways, comprising essentially a solid imperforate and substantially impervious substrate base having a top surface adapted for the collection and channeling of liquid to a drain, and a superstratum layer, which is porous throughout its depth.

The porous superstratum layer is directly bonded to the substrate base, and the latter is inclined towards the drain conduit having a plurality of slots or holes on its upper portion.

The superstratum layer may consist only of a single layer of aggregate particles and resinous binder, or of two layers, wherein the first layer is again formed with aggregate particles and resinous binder, and the second layer comprises scoria and/or slug particles and resinous binder.

This kind of draining structure has certain features in common with the present invention.

However, it can be immediately recognized that this draining structure can only solve the problem of the rapid drainage therethrough of, e.g., rainwater, fuel oil, inflammable liquids, etc., spilled by accident or under other circumstances, on the surface of the structure.

It cannot provide for sound absorption at low frequencies, since it does not include any layer serving for that purpose, between the superstratum layer and the substrate base.

DISCLOSURE OF INVENTION

Is An object of the present invention is to realize an ecotechnical (road) pavement and the related manufacturing process, wherein besides high frequency noise, also medium-low frequency noise is reduced.

Another object of the invention is to disconnect or separate the upper layers of the pavement from the lower ones, in such a way as to allow the high frequency sound to be absorbed by the upper layers, and the medium-low frequency sound to be absorbed through the effect produced by the separation layer acting like a Helmholtz resonator.

A further object of the present invention is to use the separation layer, besides for the absorption of medium-low frequency acoustic waves, also as an efficient header for water.

Still a further object of the invention is to provide lateral reservoirs or fillings consisting of light granulated material or of another type, having selective features with respect to the absorption of different liquids, and allowing for the passage of rain water while temporarily retaining dangerous liquids, in particular pollutants which were accidentally poured on the asphalt because of accidents or other circumstances, for instance the continuos accumulation of microparticles of heavy metals, residual amounts of carbon compounds, hydrocarbon particles, etc.

Said lateral reservoirs will be associated to suitable means for draining and collecting the liquids. The lateral reservoirs are directly connected to the separation layer.

Still a further object is to use low cost materials (which therefore may form fissures) for the realization of the lower supporting layers (having different thicknesses according to the type of traffic they are designed to support) , while preventing at the same time the fissures—due to fatigue—from ascending towards the surface, thereby causing breakage of the road upper structure; this object is attained by means of the structure and materials employed to produce the separation layer, which prevents this rise (anti-reflection cracking).

BRIEF DESCRIPTION OF DRAWINGS

The present invention will now be described for illustrative and non limitative purposes with reference to a particular embodiment thereof, which is shown in the drawings, wherein.

BEST MODE OF CARRYING OUT THE INVENTION

Figure 1:
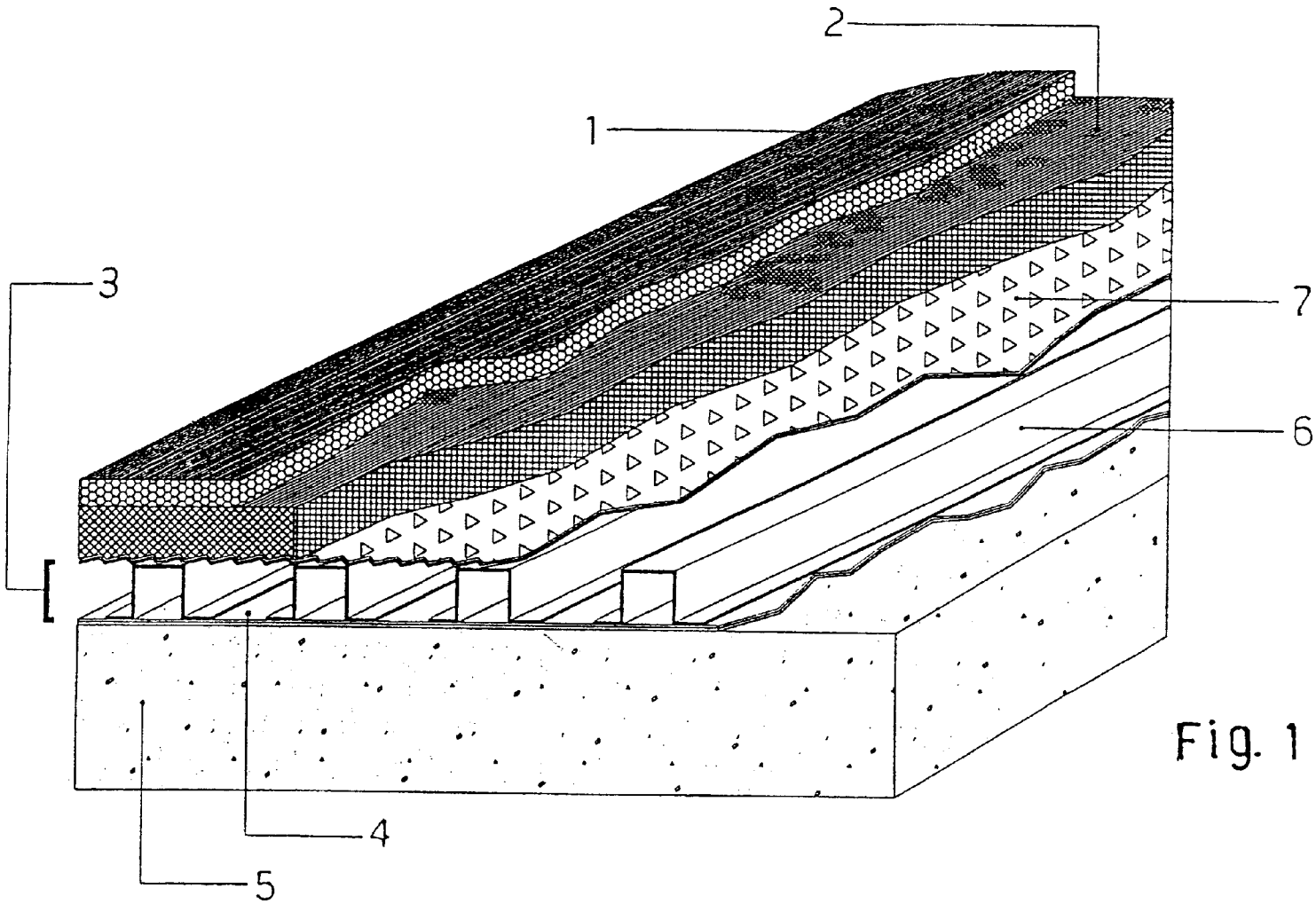
FIG. 1 is a perspective and sectional view of the pavement according to the invention.
Figure 2:
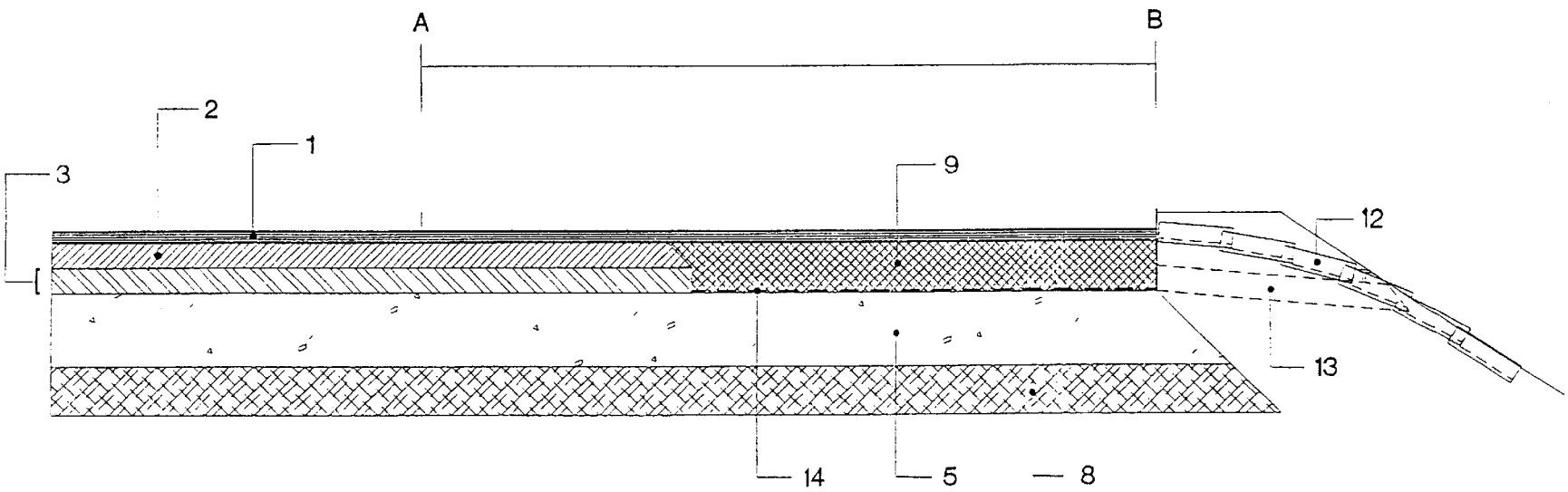
FIG. 2 is a cross sectional view according to the invention, showing the structure of the pavement on the side of the emergency lane (of a motorway)
Figure 3:
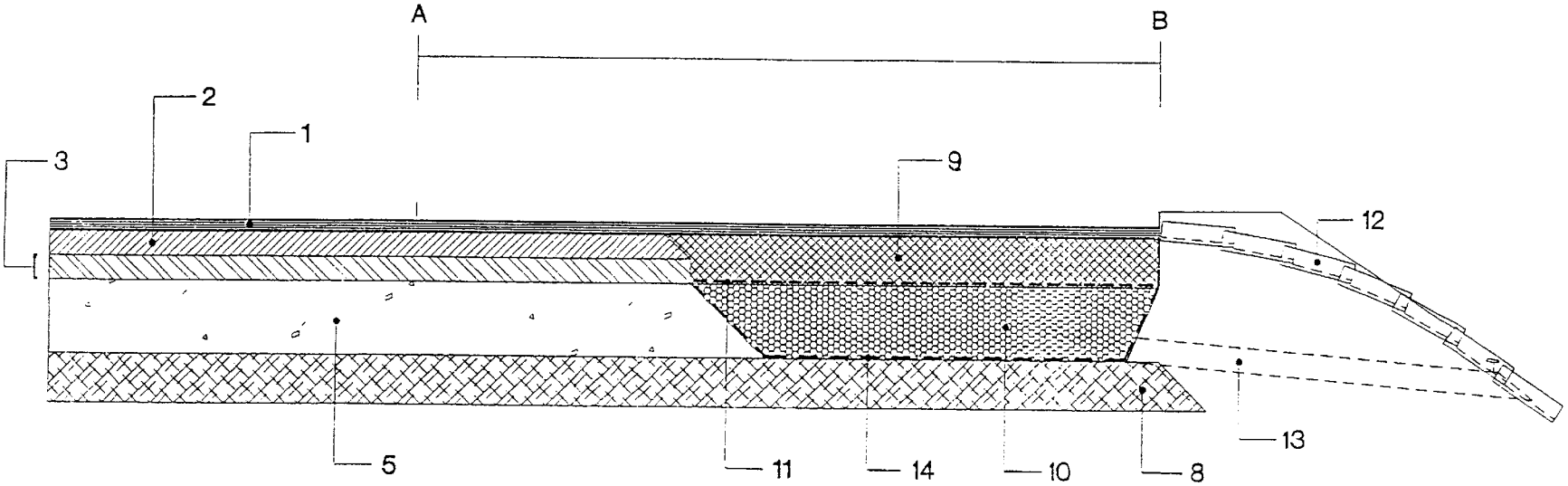
FIG. 3 is a view similar to FIG. 2, for the case of maximum protection zones.

FIG. 1 shows the structure of the pavement of the invention, in its central part, that is with the exception of the emergency lane, whereas the cross sectional views of FIGS. 2 and 3 illustrate the structure of the pavement according to the invention in the emergency lane, in the standard case (FIG. 2) and according to the solution adopted for the case of a zone requiring maximum protection (FIG. 3), where the collection of pollutants must be performed in the best possible way.

Figure 4:
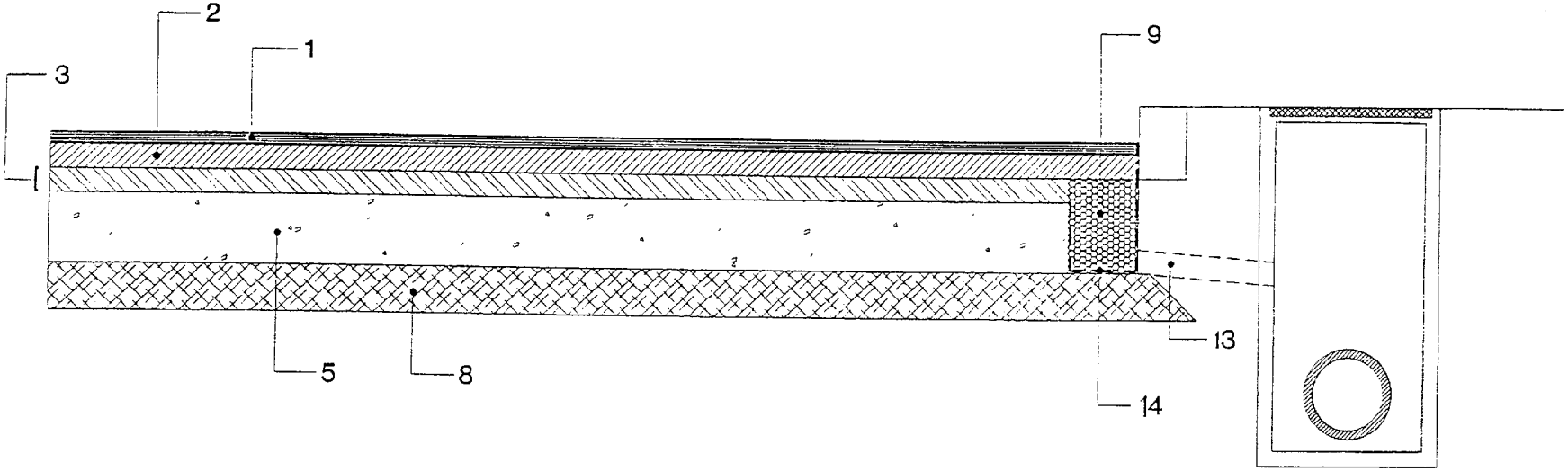
FIG. 4 is an embodiment of the pavement according to the invention, for urban use.

FIG. 4 illustrates the pavement in the urban case. As shown in FIG. 1, the pavement comprises an upper wearing and draining course 1 made of bituminous porous conglomerate, and a lower layer 2, also made of bituminous porous conglomerate.

The lower layer 2 has a greater thickness than the upper layer 1, and moreover, the two layers may differ also in their granulometry and in the type of aggregate used (hardness and shape).

The different type of aggregate used (that is the layer 2, not subject to wear, may comprise aggregate of different shape and properties than the first layer), results in different features for the layers: the lower layer 2 will have a higher percentage of voids than the layer 1.

Specifically, the tower layer 2 may form an "open" bituminous conglomerate including calcareous aggregate with at least 20–25% of voids and with a thickness of 5–10 cm.

The upper draining and wearing course 1 may include 18–20% of voids.

The two layers 1,2 have drainage properties and sound absorption features (for medium, high and very high frequencies) and are already known per se.

According to the present invention, the two layers 1,2 are "separated" from the lower supporting layer 5 of the pavement, that is, the intermediate "cooperating and separation" layer 3 includes "spacers" 6 which may be made of a variety of shapes, and which are made of steel and/or refractory material based on expanded clay mixed with cement or another binder and/or formed with plastic of suitable resistance, said spacers forming a free (void) space between the upper layers 1,2 and the lower supporting layer 5. Said spacers 6 belonging to the intermediate layer 3 may be pointed i.e. pin shaped (box-type, rod iron, vertical tubes) or they may be continuos, or discontinuous, and suitably shaped or bent, or mutually coupled and/or fixed, but in any case they should not hinder the rapid transversally directed flow of water.

In FIGS. 5, 6, 7, 8 some possible examples are shown. Illustrating other possible structures of the "cooperating and separation layer" 3.

The bottom plate 4, which is shown also in FIG. 1 and is made of steel or another material, may also be realized in a continuous or discontinuous form (for instance in a chequered fashion), and it prevents the cracks caused by fatigue from "ascending", besides transmitting the traffic loads to the supporting layer 5.

The upper layer 7 of the cooperating separation layer, is made of expanded metal of various thicknesses, and different shapes and dimensions of the holes, and it represents the principal component allowing perfect adhesion and the cooperation between the upper layers and the separation layer 3, due to the inclination of its expanded sheet-steel parts, without resorting to an adherence coat that would reduce the permeability with respect to sound and water.

Figure 6:
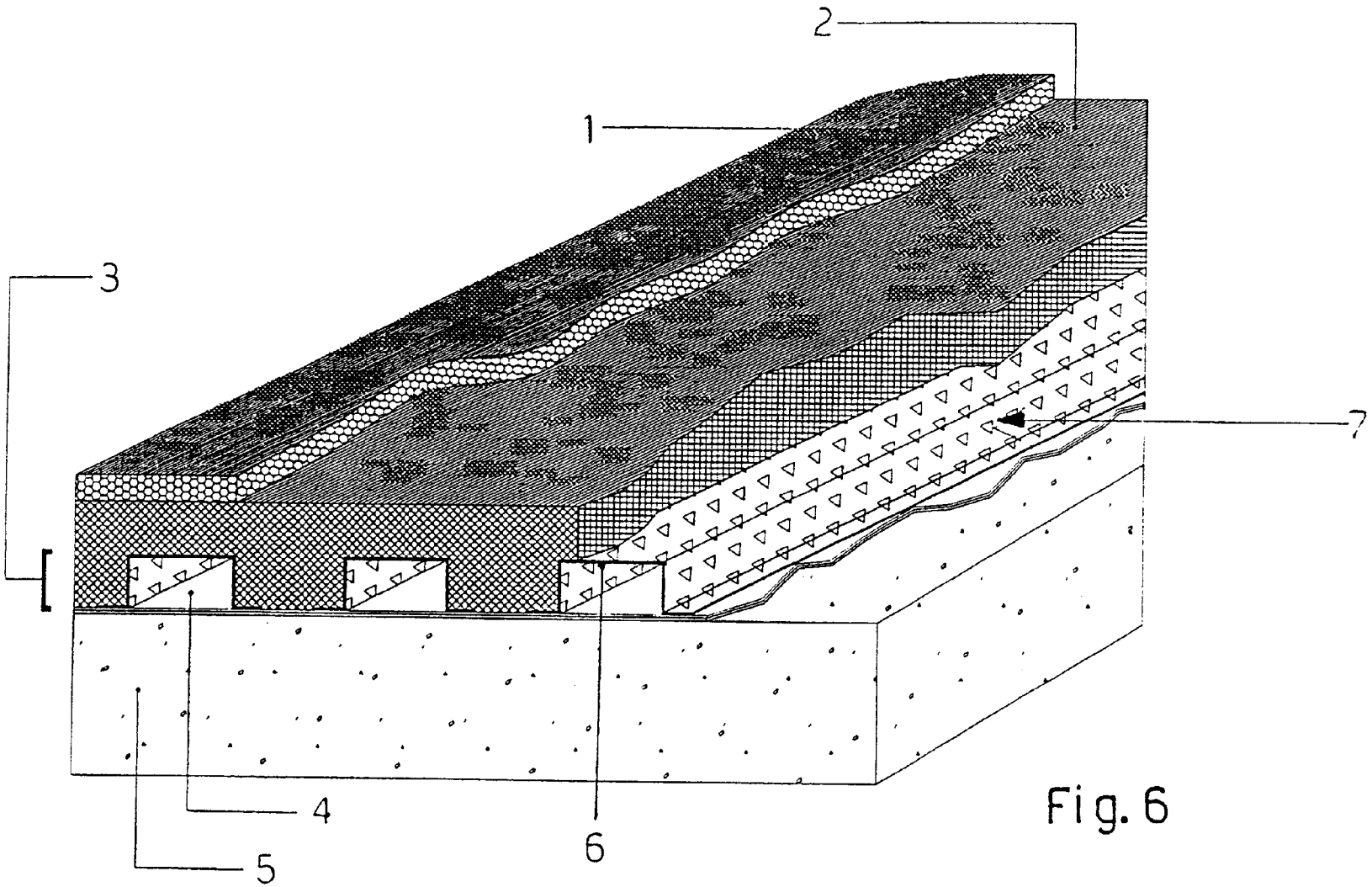
Figure 7:
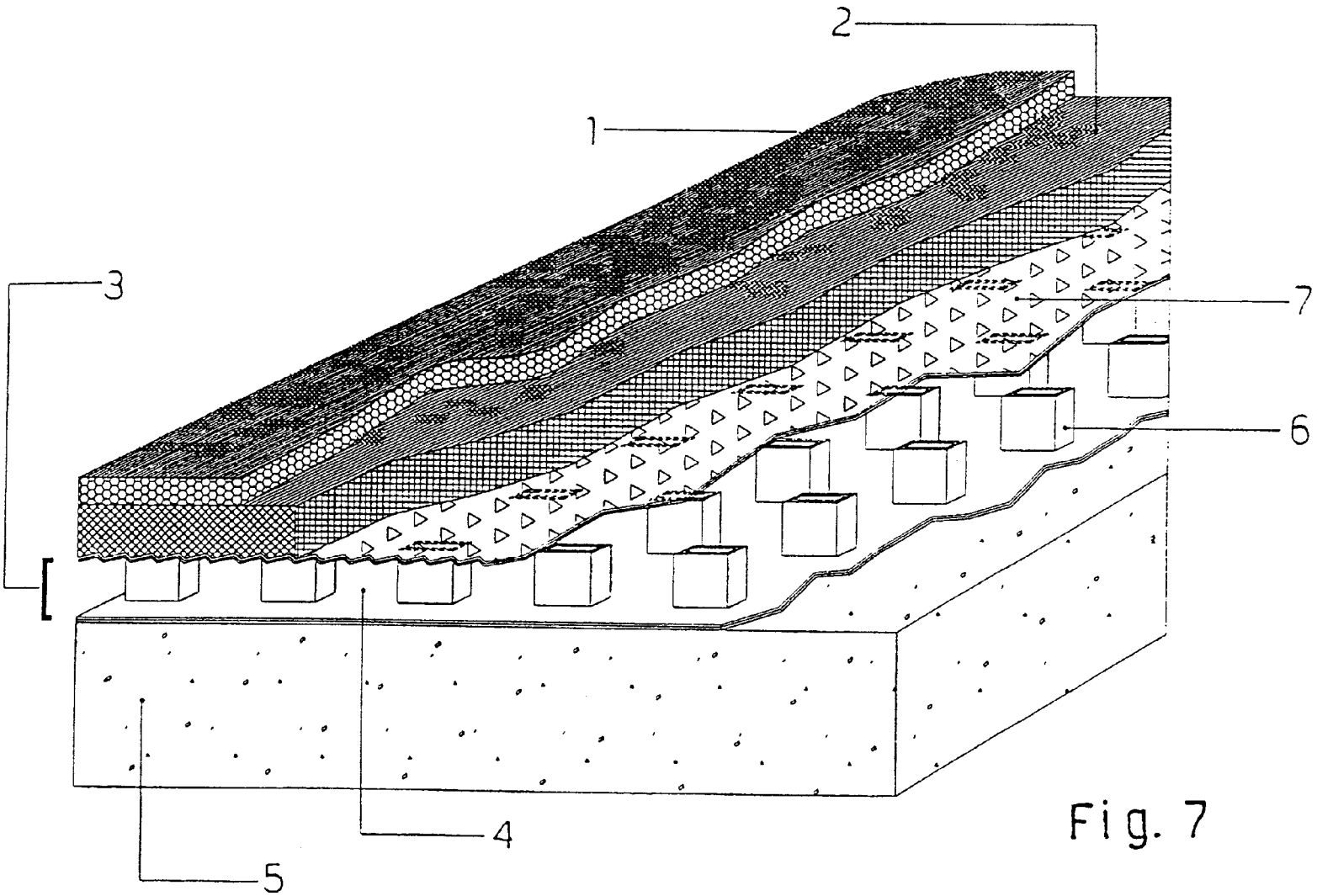
Figure 8:
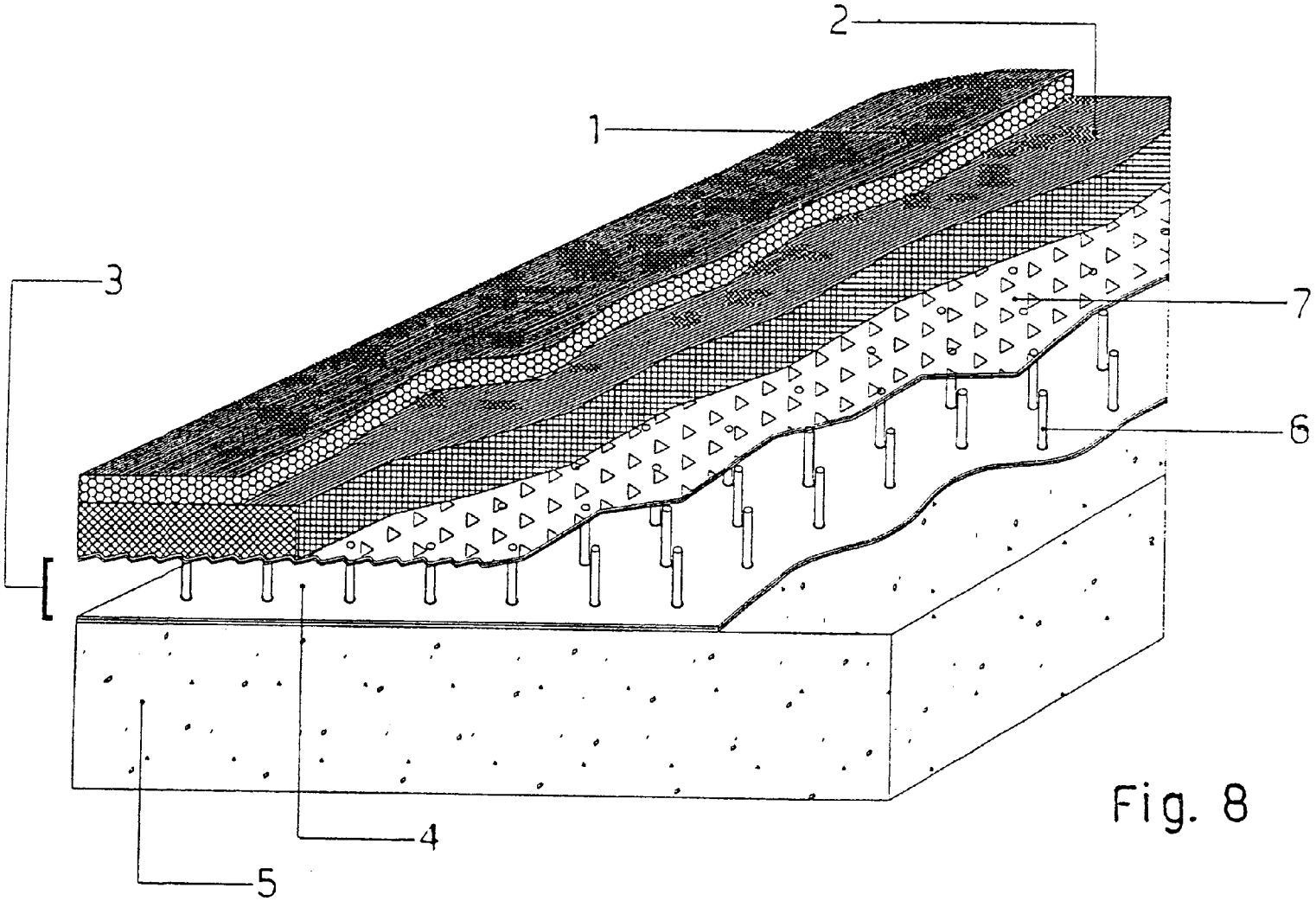

The expanded metal may be adequately shaped and in this case it may itself form the spacers 6, as can be seen from FIG. 6.

The metallic parts may be produced from normal steel, corten steel, galvanized steel, cadmium plated steel or steel protected from corrosion, or finally, from any other metal not subject to corrosion.

From experimental tests it turned out that this pavement has high acoustic absorption coefficients also in the range of medium-low frequencies due to heavy vehicles and can therefore effectively contribute to the reduction of sound produced by vehicle traffic.

Figure 5:
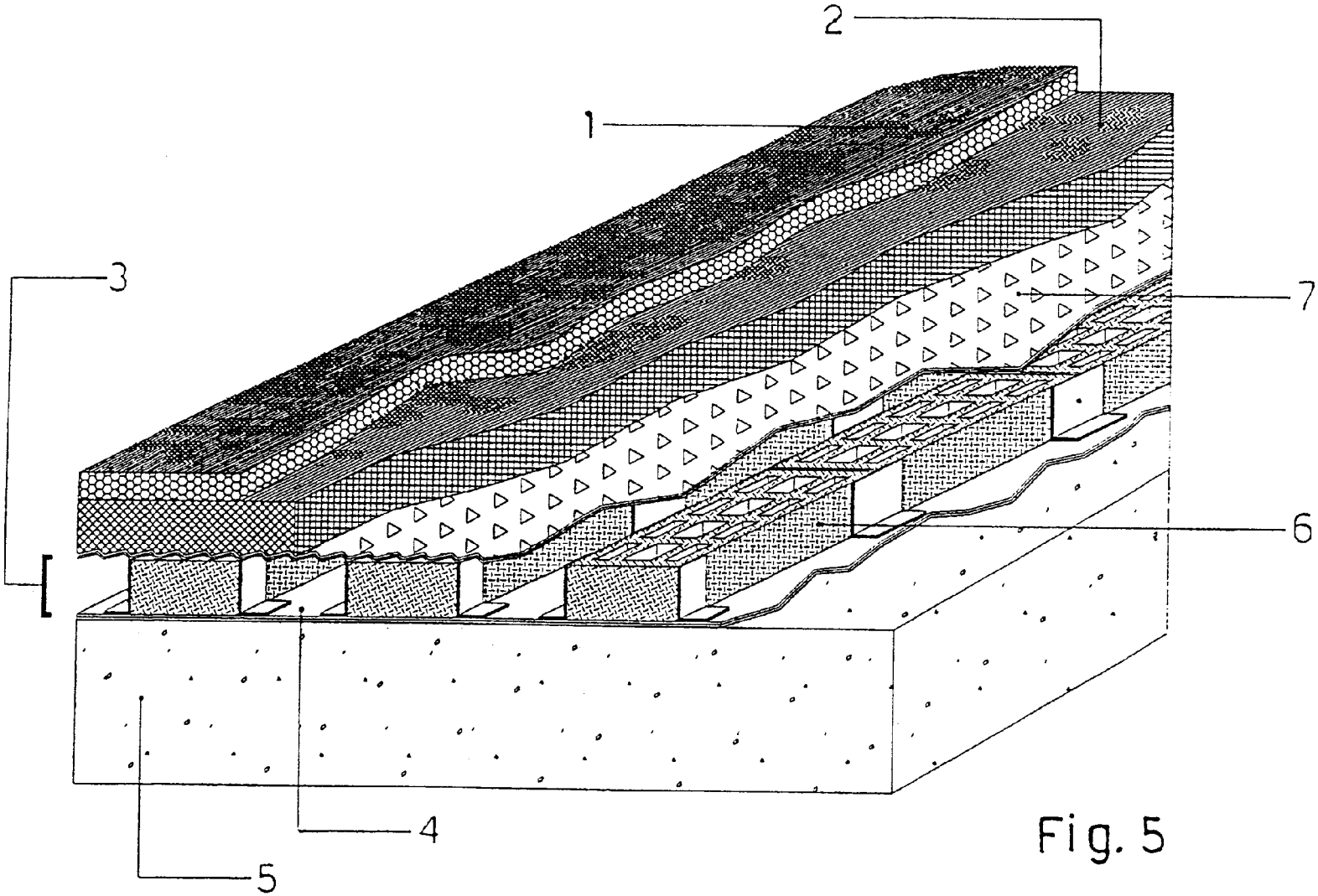
FIGS. 5, 6, 7, and 8 show other possible examples of separation layers.

The cavities (resonators) may be modified at will, by inserting in the intermediate separation layer—as shown in FIG. 5—special manufactured articles 6 of expanded clay or other similar materials which serve also to reduce the free space between the spacers 6, the latter being used to transmit loads to the lower supporting layer 5 and having variable height according to the frequencies and loads to be handled.

The embodiment of FIG. 5 provides for the alignment of the manufactured articles 6 by means of angle iron elements welded to the plate 4.

The spacers 6 must be fixed at their upper end (for example welded) to the expanded metal 7 or to a layer of perforated plastics (if the elements 6 are themselves made of plastics), and at their lower end to the plate 4.

The perforated layer 7 allows the passage—through its holes or apertures—of all liquids traversing the layers 1,2. The use of expanded metal 7 has the advantage that the latter has an irregular surface which hinders the relative tangential displacements with respect to the layer 2. The holes of the pierced steel or plastic layer 7 have dimensions such as to prevent the passage of aggregate forming the layer 2.

As mentioned previously, the lower ends of the spacers 6 are welded to a plate 4 (made of steel or plastics). The intermediate separation layer 3 produces the following effects:

- it transmits the forces generated by the vehicles (tangential forces like braking forces and centrifugal forces during turning, etc.);
- it allows the transmission of sound vibrations from the upper layer and their absorption in the low frequency range;
- it allows the passage and lateral offtake of rain water and poured liquids;
- it distributes the loads onto the lower supporting layer 5 and prevents the cracks or fissures of the lower supporting layer 5 from ascending (known as reflection crackings).

The components 4, 6, 7 of the cooperating separation layer 3 form a "package" of welded parts and they may be prefabricated or assembled during installation or—alternatively—a combination of these techniques could be employed, and the lower component 4 of the package could also be formed by a grid (network) of steel or plastics, instead of a (continuous or discontinuous, e.g. chequered) plate, as has been said above.

The whole package 4,6,7 may have for instance vertical dimensions of 5 up to 15 cm.

The lower supporting layer 5 comprises a mix including cement or the like (virgin bituminous conglomerate, or recycled with a hot or cold process). Therefore, a not excellent material, of limited costs, is preferably used in this case, in order to counterbalance either completely or in part, the costs of the separation layer. This is a further advantage provided by the invention.

Referring now to FIGS. 2, 3, 4, the numerals 1, 2 denote once again the two layers made of bituminous conglomerate providing a drainage effect and a medium-high and very high frequency absorption effect. The layer 3 (denoted by diagonal double lines in FIGS. 2, 3, 4) is the separation layer between the layers 1,2 and the lower supporting layer 5. The latter lies on a lower layer 8 formed by a granulated stabilized mix.

The (ideal) line A–B illustrates the extension of the emergency lane, if any, which is used in order to realize a "reservoir" 9 (this may be realized also by means of a vertical septum if there is not enough space available for the emergency lane).

On the right side of the FIGS. 2 and 3, it can be noted that the structure of the pavement is modified. Referring to FIG. 2, immediately below the wearing course 1, there is provided a "reservoir" 9, that is a layer of material controlling the velocity of diffusion of liquids, and retaining polluting liquids.

Said reservoir 9 may be formed—for example—of draining bituminous conglomerate of strong expanded clay (14–18% of voids). The reservoir 9 is bounded on the left (in the drawing) by the two layers 2,3, and on the lower side with the supporting layer 5, and on the right and lower side, with a seal coating 14.

As shown in FIG. 3, in the zones of maximum protection, the layer acting as a reservoir, comprises an upper layer 9 and a lower layer 10. The upper layer is formed of the same material used for the layer 9 of FIG. 2, whereas the lower layer 10 is made of an treated expanded clay (more than 20% of voids), which is treated so as to be able to selectively absorb liquid pollutants of various nature.

The two layers 9 and 10 are preferably separated by a geosynthetics grid 11, which for example may be made of polyester, The lower part of the the layer 10 is also sealed with a membrane 14.

A duct 12 allows the outflow of rainwater and terminates at the level of the pavement.

A tube 13, for instance made of PVC, collects liquid pollutants at the bottom of the reservoir 9 (FIG. 2) or 9 and 10 (FIG. 3).

The PVC tube comprises a suitable tap, and microslots are provided along its length located inside the reservoir.

The liquid collection system 12,13 may be provided at predetermined distances along the side of the pavement, according to circumstances (e.g. every 50 m).

In the drawings, reference numeral 8 denotes the road subgrade.

The present invention is not limited to the actually described embodiment, which is schematically shown in the drawings.

In particular, the structure of the spacers may be modified, as has been said in the introductory part, provided that their form does not influence the rapid transversally directed flow of rain water inside the separation layer 3.

It goes without saying that the materials forming the reservoir 9 and the structure of the latter may be modified according to circumstances. However, the essential point is that the reservoir 9 must be located directly adjacent to—or must be in communication with—the cooperating separation layer 3.

Moreover, the structure of the drainage and liquid pollutants collection system 12, 13 may be varied in various ways, and is not limited to the described embodiment. In any case, a system 13 will always be provided, which serves to "extract" from the reservoir 9 or 9,10, the dangerous or polluting liquids.

What is claimed is:

1. An environment protective pavement, comprising a porous draining and wearing course (1) and at least a porous lower layer (2) comprising bituminous, epoxy or cement binders, used to absorb sound of medium, high and very high frequencies, and a lower supporting layer (5), and a collection system (12,13) of rain water and dangerous liquids or liquid pollutants, the lower supporting layer (5) and the upper layers (1,2) being separated by a cooperating separation layer (3) including spacers (6) transmitting vertical load and transverse forces which are produced by vehicle traffic, said cooperating separation layer (3) being connected on at least one side of a roadway, to a layer acting as a reservoir (9; 9,10) which retains dangerous liquids or liquid pollutants, and which is connected in turn to said collection system (12,13); said spacers (6) being so arranged that they do not hinder rapid transverse flow of water.

2. A pavement according to claim 1, wherein below said layer or layers (2) located below the wearing course (1), there is provided a rigid plane and perforated structure (7) having an uneven surface, which is welded to said spacers (6), said spacers being welded at lower ends to a plastic or steel plate or net (4).

3. A pavement according to claim 1, wherein said spacers (6) of the separation layer (3) form cavities of sizes suited to absorb sound.

4. A pavement according to claim 1, wherein said spacers (6) are formed by an expanded metal (7).

5. A pavement according to claim 1, wherein said layer (9; 9,10) acting as a reservoir, is located below part or all of an emergency lane.

6. A pavement according to claim 1, wherein the reservoir comprises only one layer (9).

7. A pavement according to claim 6, wherein the reservoir comprises also a second layer (10) located below the first layer (9) of the reservoir, said second layer (10) being arranged flush with the lower supporting layer (5) and being provided for a zone requiring maximum protection.

8. A pavement according to claim 6, wherein the reservoir comprises at least a layer of draining bituminous conglomerate of expanded clay (9) and a lower layer (10) of treated expanded clay which is oil-absorbing or which absorbs other particular substances which pollute the environment.

9. A pavement according to claim 1, wherein said collection system (12,13) of rain water and dangerous liquids or liquid pollutants, comprises valves of safety taps.

10. A pavement according to claim 9, wherein said collection system comprises tubes or ducts, some of them ending at a level of an upper surface of a pavement, and others at a bottom of the reservoir (9 and 9,10) or at a level of any layer of the reservoir.

11. A pavement according to claim 7, wherein layers (9,10) of the reservoir are separated by a geosynthetic grid.

12. A pavement according to claim 3, wherein manufactured articles are introduced inside the separation layer (3), together with other elements, in order to provide said spacers (6).

* * * * *

UNITED STATES PATENT AND TRADEMARK OFFICE

CERTIFICATE OF CORRECTION

PATENT NO. : 6,379,079 B1
DATED : April 30, 2002
INVENTOR(S) : Gabriele Camomilla It is certified that error appears in the above-identified patent and that said Letters Patent is hereby corrected as shown below:

Column 1,
Delete lines 39-65.

Column 2,
Line 25, delete "Is".

Signed and Sealed this

Eighteenth Day of June, 2002

*Attest:*

*Attesting Officer*

JAMES E. ROGAN
*Director of the United States Patent and Trademark Office*